US011678409B2

(12) United States Patent
Antonopoulos et al.

(10) Patent No.: US 11,678,409 B2
(45) Date of Patent: Jun. 13, 2023

(54) HEATER ASSEMBLY FOR AN AEROSOL-GENERATING DEVICE

(71) Applicant: Philip Morris Products S.A., Neuchatel (CH)

(72) Inventors: Roland Antonopoulos, Neuchatel (CH); Kok Hwa Liew, Singapore (SG)

(73) Assignee: Philip Morris Products S.A., Neuchatel (CH)

( * ) Notice: Subject to any disclaimer, the term of this patent is extended or adjusted under 35 U.S.C. 154(b) by 630 days.

(21) Appl. No.: 16/609,505

(22) PCT Filed: May 2, 2018

(86) PCT No.: PCT/EP2018/061226
§ 371 (c)(1),
(2) Date: Oct. 30, 2019

(87) PCT Pub. No.: WO2018/202727
PCT Pub. Date: Nov. 8, 2018

(65) Prior Publication Data

US 2020/0084838 A1 Mar. 12, 2020

(30) Foreign Application Priority Data

May 2, 2017 (EP) ..... 17169081

(51) Int. Cl.
*H05B 3/06* (2006.01)
*H05B 3/14* (2006.01)
(Continued)

(52) U.S. Cl.
CPC ..... *H05B 3/46* (2013.01); *A24F 40/46* (2020.01); *A24F 40/50* (2020.01); *A24F 40/57* (2020.01);
(Continued)

(58) Field of Classification Search
None
See application file for complete search history.

(56) References Cited

U.S. PATENT DOCUMENTS 9,674,894 B2 * 6/2017 Schneider ..... H05B 3/0014
10,130,121 B2 * 11/2018 Plojoux ..... A24F 3/02
(Continued)

FOREIGN PATENT DOCUMENTS

CN 203630559 U 6/2014
EP 2 399 636 A1 12/2011
(Continued)

OTHER PUBLICATIONS

Combined Office Action and Search Report dated Aug. 18, 2021 in corresponding Russian Patent Application No. 2019138056 (with English Translation), 18 pages.
(Continued)

*Primary Examiner* — Joseph M. Pelham
(74) *Attorney, Agent, or Firm* — Obion, McClelland, Maier & Neustadt, L.L.P.

(57) ABSTRACT

A removable heater assembly for an aerosol-generating device is provided, the removable heater assembly being configured to heat a tobacco plug and including an electrical heater, a data storage device, and data stored on the data storage device, the data including calibration data for the electrical heater. An aerosol-generating device is also provided, including the removable heater assembly, a housing defining a cavity configured to removably receive the removable heater assembly and an aerosol-generating article, a power supply, and a controller configured to receive data from the data storage device of the removable heater assembly and to control a supply of electrical power from the power supply to the electrical heater of the removable heater assembly based on the received data.

22 Claims, 2 Drawing Sheets

(51) Int. Cl.

| | |
|---|---|
| ***H05B 3/46*** | (2006.01) |
| ***A24F 47/00*** | (2020.01) |
| ***H01R 13/22*** | (2006.01) |
| ***H01R 13/62*** | (2006.01) |
| ***H01R 24/52*** | (2011.01) |
| ***H05B 1/02*** | (2006.01) |
| ***A24F 40/46*** | (2020.01) |
| ***A24F 40/50*** | (2020.01) |
| ***A24F 40/65*** | (2020.01) |
| ***A24F 40/57*** | (2020.01) |
| ***H01R 13/64*** | (2006.01) |
| *A24F 40/20* | (2020.01) |
| *H01R 107/00* | (2006.01) |

(52) U.S. Cl.

CPC ..... *A24F 40/65* (2020.01); *H01R 13/6205* (2013.01); *H01R 13/64* (2013.01); *H01R 24/52* (2013.01); *H05B 1/0297* (2013.01); *H05B 3/06* (2013.01); *A24F 40/20* (2020.01); *H01R 2107/00* (2013.01); *H05B 2203/016* (2013.01)

(56) References Cited

U.S. PATENT DOCUMENTS

| | | | | |
|---|---|---|---|---|
| 10,667,329 | B2 * | 5/2020 | Bernauer | A24F 40/50 |
| 10,813,174 | B2 * | 10/2020 | Schneider | A24F 40/46 |
| 11,278,052 | B2 * | 3/2022 | Mitrev | A24D 1/20 |
| 2005/0045198 | A1 * | 3/2005 | Larson | A24F 40/85 131/194 |
| 2011/0155718 | A1 * | 6/2011 | Greim | H05B 3/0019 219/539 |
| 2014/0305448 | A1 * | 10/2014 | Zuber | A24D 1/20 131/328 |
| 2014/0345633 | A1 | 11/2014 | Talon et al. | |
| 2014/0345634 | A1 * | 11/2014 | Zuber | A24D 3/00 131/328 |
| 2014/0366896 | A1 * | 12/2014 | Li | A24F 40/40 131/329 |
| 2014/0373856 | A1 * | 12/2014 | Zuber | A24D 1/20 131/328 |
| 2015/0013696 | A1 * | 1/2015 | Plojoux | A24F 40/40 131/328 |
| 2015/0163859 | A1 * | 6/2015 | Schneider | A24F 40/46 219/535 |
| 2015/0208729 | A1 * | 7/2015 | Monsees | A24F 40/42 131/329 |
| 2015/0216232 | A1 | 8/2015 | Bless et al. | |
| 2015/0282525 | A1 * | 10/2015 | Plojoux | A24F 9/04 239/104 |
| 2015/0359263 | A1 * | 12/2015 | Bellinger | A24F 40/57 392/394 |
| 2016/0050974 | A1 | 2/2016 | Galloway et al. | |
| 2016/0255878 | A1 * | 9/2016 | Huang | A24F 40/51 |
| 2016/0360785 | A1 * | 12/2016 | Bless | A24F 40/40 |
| 2016/0363570 | A1 * | 12/2016 | Blackley | A61M 15/0003 |
| 2017/0156405 | A1 | 6/2017 | Galloway et al. | |
| 2017/0164659 | A1 * | 6/2017 | Schneider | A24F 40/46 |
| 2017/0188634 | A1 * | 7/2017 | Plojoux | A24F 40/85 |
| 2017/0231276 | A1 * | 8/2017 | Mironov | H05B 1/0244 131/328 |
| 2017/0231277 | A1 * | 8/2017 | Mironov | A24F 40/40 392/404 |
| 2017/0245553 | A1 * | 8/2017 | Reevell | A24F 40/51 |
| 2018/0000157 | A1 | 1/2018 | Batista et al. | |
| 2018/0007971 | A1 * | 1/2018 | Plojoux | A24F 40/46 |
| 2018/0020735 | A1 * | 1/2018 | Bilat | A24F 40/50 131/328 |
| 2018/0049466 | A1 * | 2/2018 | Cyphert | A24F 7/04 |
| 2018/0084608 | A1 | 3/2018 | Bernauer et al. | |
| 2018/0279682 | A1 * | 10/2018 | Guo | H01M 50/284 |
| 2018/0303161 | A1 * | 10/2018 | Bilat | A24F 40/40 |
| 2019/0037921 | A1 * | 2/2019 | Kennedy | A24F 40/42 |
| 2019/0045834 | A1 * | 2/2019 | Fuisz | A24B 15/24 |
| 2019/0104767 | A1 * | 4/2019 | Hatton | A24F 40/51 |
| 2019/0342950 | A1 * | 11/2019 | Bernauer | A24F 40/57 |
| 2020/0046033 | A1 * | 2/2020 | Robert | H05B 3/42 |
| 2020/0163384 | A1 * | 5/2020 | Rossoll | A24F 40/53 |
| 2020/0236999 | A1 * | 7/2020 | Mironov | H05B 6/108 |
| 2020/0237000 | A1 * | 7/2020 | Stura | H05B 6/108 |
| 2020/0413495 | A1 * | 12/2020 | Schneider | A24F 40/46 |
| 2021/0212170 | A1 * | 7/2021 | Bilat | H05B 1/0297 |
| 2022/0015443 | A1 * | 1/2022 | Lacovara | G06N 3/08 |
| 2022/0086959 | A1 * | 3/2022 | Mironov | A24F 40/40 |

FOREIGN PATENT DOCUMENTS

| | | | |
|---|---|---|---|
| RU | 2 600 092 | C2 | 10/2016 |
| WO | WO 2016/120177 | A1 | 8/2016 |
| WO | WO 2016/166064 | A1 | 10/2016 |

OTHER PUBLICATIONS

International Search Report and Written Opinion dated Jul. 16, 2018 in PCT/EP2018/061226 filed on May 2, 2018.

Combined Chinese Office Action and Search Report dated Jan. 6, 2022 in Chinese Patent Appiication No. 2018800253105 (with English translation), 25 pages.

Japanese Office Action dated Jun. 9, 2022 in Japanese Patent Application No. 2019-560177 (with English translation), 7 pages.

* cited by examiner

HEATER ASSEMBLY FOR AN AEROSOL-GENERATING DEVICE

The present invention relates to a removable heater assembly for an aerosol-generating device, the heater assembly comprising a data storage device storing calibration data for the heater. The present invention also relates to an aerosol-generating device comprising the removable heater assembly.

One type of aerosol-generating system is an electrically operated smoking system. Known handheld electrically operated smoking systems typically comprise an aerosol-generating device comprising a battery, control electronics and an electric heater for heating a smoking article designed specifically for use with the aerosol-generating device. In some examples, the smoking article comprises a plug of an aerosol-forming substrate, such as a tobacco plug, and the heater contained within the aerosol-generating device is inserted into the aerosol-forming substrate when the smoking article is inserted into the aerosol-generating device. However, the electric heater may become contaminated with material from the aerosol-forming substrate during use and cleaning the electric heater inside the device can be difficult. In some cases, it may be necessary to dispose of the entire device if the heater cannot be adequately cleaned.

Accordingly, it would be desirable to produce an aerosol-generating device that addresses the issue of heater contamination.

According to a first aspect of the present invention there is provided a heater assembly configured for removable attachment to an aerosol-generating device, the heater assembly comprising an electrical heater, a data storage device, and data stored on the data storage device, the data comprising calibration data for the electrical heater.

Advantageously, providing a heater assembly configured for removable attachment to an aerosol-generating device facilitates cleaning of the electrical heater. That is, the heater assembly may be removed from an aerosol-generating device for cleaning.

Advantageously, providing a heater assembly configured for removable attachment to an aerosol-generating device may extend the useful life of an aerosol-generating device. For example, if the heater assembly is the first component of an aerosol-generating device to reach the end of its useful life, the heater assembly may be removed and replaced with a new heater assembly.

Advantageously, providing the heater assembly with a data storage device storing calibration data for the electrical heater may facilitate reliable heating of an aerosol-generating article with an aerosol-generating device comprising the heater assembly. That is, the aerosol-generating device may be configured to use the calibration data to configure a supply of electrical power to the electrical heater during heating of an aerosol-generating article. The calibration data may account for differences between heater assemblies due to manufacturing tolerances.

Preferably, the heater assembly further comprises a heater assembly attachment connector for removably attaching the heater assembly to an aerosol-generating device. The heater assembly attachment connector may comprise at least one of a resilient clip, a screw connector, a bayonet connector, and a magnetic connector.

Preferably, the heater assembly further comprises a first heater electrical contact and a second heater electrical contact, the first and second heater electrical contacts configured to receive a supply of electrical energy for supply to the electrical heater for heating the electrical heater.

In embodiments in which the heater assembly comprises a magnetic connector for removably attaching the heater assembly to an aerosol-generating device, at least one of the first and second heater electrical contacts may form the magnetic connector.

Preferably, the heater assembly comprises a base portion having a first end face on which the first and second heater electrical contacts are positioned and a second end face on which the electrical heater is positioned. Providing the first and second heater electrical contacts on an end face of a base portion may facilitate a reliable connection between the first and second heater electrical contacts and one or more electrical contacts on an aerosol-generating device.

In embodiments in which the heater assembly comprises a heater assembly attachment connector, preferably the heater assembly attachment connector is provided on the base portion. The heater assembly attachment connector may retain the first and second heater electrical contacts in electrical connection with one or more electrical contacts on an aerosol-generating device.

The first and second heater electrical contacts may be circular electrical contacts positioned concentrically on the first end face of the base portion. Advantageously, this arrangement may facilitate attachment of the heater assembly to an aerosol-generating device in a plurality of rotational orientations. In embodiments in which the base portion has a circular cross-sectional shape, the circular first and second heater electrical contacts may facilitate attachment of the heater assembly to an aerosol-generating device in any rotational orientation.

The first and second heater electrical contacts may be spaced apart from each other and the heater assembly may comprise an indexing indicator to indicate the rotational orientation of the heater assembly with respect to an aerosol-generating device. Advantageously, providing an indexing indicator on the heater assembly may facilitate attachment of the heater assembly to an aerosol-generating device in a correct orientation so that the first and second heater electrical contacts are aligned with and contact corresponding electrical contacts on the aerosol-generating device.

In embodiments in which the heater assembly comprises a base portion, preferably the indexing indicator is provided on the base portion.

The heater assembly may comprise a shaped portion, such as a raised portion or an indentation, which forms the indexing indicator. The indexing indicator may cooperate with a correspondingly shaped portion on an aerosol-generating device. For example, the heater assembly may comprise a groove in an outer surface of the heater assembly which must be aligned with a correspondingly shaped ridge on an interior surface of an aerosol-generating device to allow insertion of the heater assembly into the device.

The indexing indicator may comprise one or more indicia provided on an outer surface of the heater assembly, which must be aligned with one or more corresponding indicia provided on an aerosol-generating device.

The heater assembly may comprise a third heater electrical contact and a fourth heater electrical contact, the third and fourth heater electrical contacts configured to facilitate measurement of an electrical resistance of the electrical heater. The third and fourth heater electrical contacts may be used to measure the electrical resistance of the electrical heater during manufacture of the heater assembly for generating the calibration data.

Preferably, the electrical heater comprises a resistive heating element having a first end connected to the first and third heater electrical contacts and a second end connected to the second and fourth heater electrical contacts.

Preferably, the first electrical contact has a first electrical resistance, the second electrical contact has a second electrical resistance, the third electrical contact has a third electrical resistance, and the fourth electrical contact has a fourth electrical resistance, wherein the third electrical resistance is smaller than the first electrical resistance, and wherein the fourth electrical resistance is smaller than the second electrical resistance. Advantageously, the lower electrical resistance of the third and fourth heater electrical contacts compared to the first and second heater electrical contacts may facilitate a more accurate measurement of the resistance of the resistive heating element using the third and fourth heater electrical contacts.

The electrical heater may be an elongate electrical heater. That is, the electrical heater may have an elongate shape. Advantageously, an elongate electrical heater may facilitate insertion of the electrical heater into an aerosol-forming substrate of an aerosol-generating article. In embodiments in which the heater assembly comprises a base portion, preferably the elongate electrical heater protrudes from the second end face of the base portion.

The calibration data stored on the data storage device may represent a voltage-temperature profile for the electrical heater.

In addition to storing calibration data for the electrical heater, the data storage device may be configured to store additional data. The data storage device may be configured to store data comprising one or more heating profiles. The data storage device may be configured to store usage data. The data storage device may be configured to store data indicative of the heater assembly having reached the end of its useful life.

Preferably, the heater assembly further comprises a heater communication interface for providing data transfer between the data storage device and an aerosol-generating device.

The heater communication interface may comprises a wireless data connector. The wireless data connector may be configured to operate using at least one of radio-frequency identification (RFID), near-field communication (NFC), Bluetooth, ZigBee, Wi-Fi, and Ultra-wideband.

The heater communication interface may comprise at least one heater data electrical contact configured for connection to at least one device data electrical contact on an aerosol-generating device. Preferably, the at least one heater data electrical contact comprises a first heater data electrical contact and a second heater data electrical contact. In embodiments in which the heater assembly comprises third and fourth heater electrical contacts, the third and fourth heater electrical contacts may also function as the first and second heater data electrical contacts.

Preferably, the data storage device comprises at least one type of non-volatile data storage. The non-volatile data storage may comprise at least one of semiconductor data storage, magnetic data storage, and optical data storage.

The electrical heater may comprise an electrically insulating substrate and a resistive heating element provided on the electrically insulating substrate.

Preferably, the electrically insulating substrate is operable at a working temperature of up to about 700 degrees Celsius, more preferably about 800 degrees Celsius. Additionally, or alternatively, the operating temperature of the resistive heating element during use may be about 250 degrees Celsius, more preferably about 300 degrees Celsius.

The electrically insulating substrate may be a ceramic material such as Zirconia or Alumina. Preferably, the electrically insulating substrate has a thermal conductivity of less than or equal to about 2 Watts per metre Kelvin.

The electrically insulating substrate may comprise a planar surface on which the resistive heating element is positioned and a tapered end configured to allow for insertion of the electrical heater into an aerosol-forming substrate.

In embodiments in which the heater assembly comprises a base portion, preferably the base portion is formed from an electrically insulating material. Preferably, the base portion is formed from the same material as the electrically insulating substrate. Preferably, the base portion and the electrically insulating substrate are integrally formed.

Suitable materials for forming the resistive heating element include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys.

In some embodiments, the resistive heating element comprises one or more stamped portions of electrically resistive material, such as stainless steel. Alternatively, the resistive heating element may comprise a heating wire or filament, for example a Ni—Cr (Nickel-Chromium), platinum, tungsten or alloy wire.

According to a second aspect of the present invention, there is provided an aerosol-generating device comprising a heater assembly according to the first aspect of the present invention, in accordance with any of the embodiments described herein. The aerosol-generating device further comprises a housing defining a cavity for receiving an aerosol-generating article, wherein the cavity is configured to removably receive the heater assembly. The aerosol-generating device also comprises a power supply, and a controller configured to receive data from the data storage device of the heater assembly and to control a supply of electrical power from the power supply to the electrical heater of the heater assembly based on the received data.

In embodiments in which the heater assembly comprises a heater assembly attachment connector, preferably the aerosol-generating device comprises a device attachment connector positioned within the cavity and configured to cooperate with the heater assembly attachment connector to removably attach the heater assembly within the cavity.

In embodiments in which the heater assembly comprises first and second heater electrical contacts, preferably the aerosol-generating device comprises a first device electrical contact positioned within the cavity and configured for electrical connection with the first heater electrical contact, and a second device electrical contact positioned within the cavity and configured for electrical connection with the second heater electrical contact, wherein the controller is configured to control a supply of electrical power from the power supply to the electrical heater via the first and second device electrical contacts and the first and second heater electrical contacts.

In embodiments in which the heater assembly comprises a heater communication interface, preferably the aerosol-generating device comprises a device communication interface configured to establish a data link with the heater communication interface.

In embodiments in which the heater communication interface comprises a wireless data connector, preferably the device communication interface comprises a wireless data connector configured to use the same wireless protocol as the heater communication interface.

In embodiments in which the heater communication interface comprises at least one heater data electrical contact, preferably the device communication interface comprises at least one device data electrical contact configured to contact the at least one heater data electrical contact when the heater assembly is removably received within the cavity.

In addition to receiving calibration data from the data storage device, the controller may be configured to write data to the data storage device. The controller may be configured to write usage data to the data storage device. The controller may be configured to write data to the data storage device to indicate when the heater assembly has reached the end of its useful life. The controller may be configured to receive data from the data storage assembly indicative of the heater assembly having reached the end of its useful life, wherein the controller is configured to prevent use of the heater assembly with the aerosol-generating device upon receipt of such data.

The power supply may be a DC voltage source. In preferred embodiments, the power supply is a battery. For example, the power supply may be a nickel-metal hydride battery, a nickel cadmium battery, or a lithium based battery, for example a lithium-cobalt, a lithium-iron-phosphate or a lithium-polymer battery. The power supply may alternatively be another form of charge storage device such as a capacitor. The power supply may require recharging and may have a capacity that allows for the storage of enough energy for use of the aerosol-generating device with one or more aerosol-generating articles.

Preferably, the aerosol-generating device comprises at least one air inlet. Preferably, the at least one air inlet is in fluid communication with an upstream end of the cavity.

The aerosol-generating device may comprise a sensor to detect air flow indicative of a consumer taking a puff. The air flow sensor may be an electro-mechanical device. The air flow sensor may be any of: a mechanical device, an optical device, an opto-mechanical device and a micro electro-mechanical systems (MEMS) based sensor. The aerosol-generating device may comprise a manually operable switch for a consumer to initiate a puff.

The aerosol-generating device may comprise a temperature sensor. The temperature sensor may detect the temperature of the electrical heater or the temperature of an aerosol-generating article received within the cavity. The temperature sensor may be a thermistor. The temperature sensor may comprise a circuit configured to measure the resistivity of the electrical heater and derive a temperature of the resistive heating element by comparing the measured resistivity to a calibrated curve of resistivity against temperature. In embodiments in which the heater assembly comprises first and second heater electrical contacts, the resistivity may be measured using the first and second heater electrical contacts. In embodiments in which the heater assembly comprises third and fourth heater electrical contacts, the resistivity may be measured using the third and fourth heater electrical contacts.

Preferably, the aerosol-generating device comprises an indicator for indicating when the electrical heater is activated. The indicator may comprise a light, activated when the electrical heater is activated.

In embodiments in which the heater assembly comprises first and second heater electrical contacts, the aerosol-generating device may comprise an indicator for indicating when the first and second heater electrical contacts are in correct contact with first and second device electrical contacts.

In any of the embodiments described above, the aerosol-generating device may comprise at least one of an external plug or socket and at least one external electrical contact allowing the aerosol-generating device to be connected to another electrical device. For example, the aerosol-generating device may comprise a USB plug or a USB socket to allow connection of the aerosol-generating device to another USB enabled device. For example, the USB plug or socket may allow connection of the aerosol-generating device to a USB charging device to charge a rechargeable supply of electrical energy within the aerosol-generating device. The USB plug or socket may additionally, or alternatively, support the transfer of data to or from, or both to and from, the aerosol-generating device. Additionally, or alternatively, the device may be connected to a computer to transfer data to the device, such as new heating profiles for new aerosol-generating articles.

In those embodiments in which the device comprises a USB plug or socket, the device may further comprise a removable cover that covers the USB plug or socket when not in use. In embodiments in which the USB plug or socket is a USB plug, the USB plug may additionally or alternatively be selectively retractable within the device.

According to a third aspect of the present invention, there is provided an aerosol-generating system comprising an aerosol-generating device according to the second aspect of the present invention, in accordance with the second aspect of the present invention, in accordance with any of the embodiments described herein, and an aerosol-generating article comprising an aerosol-forming substrate.

The aerosol-forming substrate may comprise a plug of tobacco. The tobacco plug may comprise one or more of: powder, granules, pellets, shreds, spaghettis, strips or sheets containing one or more of: tobacco leaf, fragments of tobacco ribs, reconstituted tobacco, homogenised tobacco, extruded tobacco and expanded tobacco. Optionally, the tobacco plug may contain additional tobacco or non-tobacco volatile flavour compounds, to be released upon heating of the tobacco plug. Optionally, the tobacco plug may also contain capsules that, for example, include the additional tobacco or non-tobacco volatile flavour compounds. Such capsules may melt during heating of the tobacco plug. Alternatively, or in addition, such capsules may be crushed prior to, during, or after heating of the tobacco plug.

Where the tobacco plug comprises homogenised tobacco material, the homogenised tobacco material may be formed by agglomerating particulate tobacco. The homogenised tobacco material may be in the form of a sheet. The homogenised tobacco material may have an aerosol-former content of greater than 5 percent on a dry weight basis. The homogenised tobacco material may alternatively have an aerosol former content of between 5 percent and 30 percent by weight on a dry weight basis. Sheets of homogenised tobacco material may be formed by agglomerating particulate tobacco obtained by grinding or otherwise comminuting one or both of tobacco leaf lamina and tobacco leaf stems; alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof. Sheets of homogenised tobacco material are preferably formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface.

The aerosol-generating article may have a total length of between approximately 30 millimetres and approximately 100 millimetres. The aerosol-generating article may have an external diameter of between approximately 5 millimetres and approximately 13 millimetres.

The aerosol-generating article may comprise a mouthpiece positioned downstream of the tobacco plug. The mouthpiece may be located at a downstream end of the aerosol-generating article. The mouthpiece may be a cellulose acetate filter plug. Preferably, the mouthpiece is approximately 7 millimetres in length, but can have a length of between approximately 5 millimetres to approximately 10 millimetres.

The tobacco plug may have a length of approximately 10 millimetres. However it is most preferable for the tobacco plug to have a length of approximately 12 millimetres.

The diameter of the tobacco plug may be between approximately 5 millimetres and approximately 12 millimetres.

In a preferred embodiment, the aerosol-generating article has a total length of between approximately 40 millimetres and approximately 50 millimetres. Preferably, the aerosol-generating article has a total length of approximately 45 millimetres. It is also preferable for the aerosol-generating article to have an external diameter of approximately 7.2 millimetres.

According to a fourth aspect of the present invention there is provided a method of assembling a heater assembly according to the first aspect of the present invention, in accordance with any of the embodiments described herein. The method comprises providing an electrical heater and a data storage device. The electrical heater and the data storage device are combined to form a heater assembly. Electrical power is supplied to the electrical heater and calibration data for the electrical heater is collected during the step of supplying power to the electrical heater. The calibration data is stored on the data storage device.

According to a fifth aspect of the present invention there is provided a method of assembling an aerosol-generating device according to the second aspect of the present invention, in accordance with any of the embodiments described herein. The method comprises providing a housing defining a cavity for receiving an aerosol-generating article. A controller and a power supply are positioned within the housing and a heater assembly is inserted into the cavity, the heater assembly being a heater assembly according to the first aspect of the present invention, in accordance with any of the embodiments described herein.

According to a sixth aspect of the present invention there is provided a method of replacing a heater assembly within an aerosol-generating device, the method comprising providing an aerosol-generating device according to the second aspect of the present invention, in accordance with any of the embodiments described herein. The heater assembly is removed from the cavity of the aerosol-generating device and a replacement heater assembly is provided, the replacement heater assembly comprising a heater assembly according to the first aspect of the present invention, in accordance with any of the embodiments described herein. The replacement heater assembly is inserted into the cavity.

According to a seventh aspect, the present invention extends to the use of a heater assembly in an aerosol-generating device, the heater assembly being a heater assembly according to the first aspect of the present invention in accordance with any of the embodiments described herein.

The invention will now be further described, by way of example only, with reference to the accompanying drawings in which.

Figure 1:
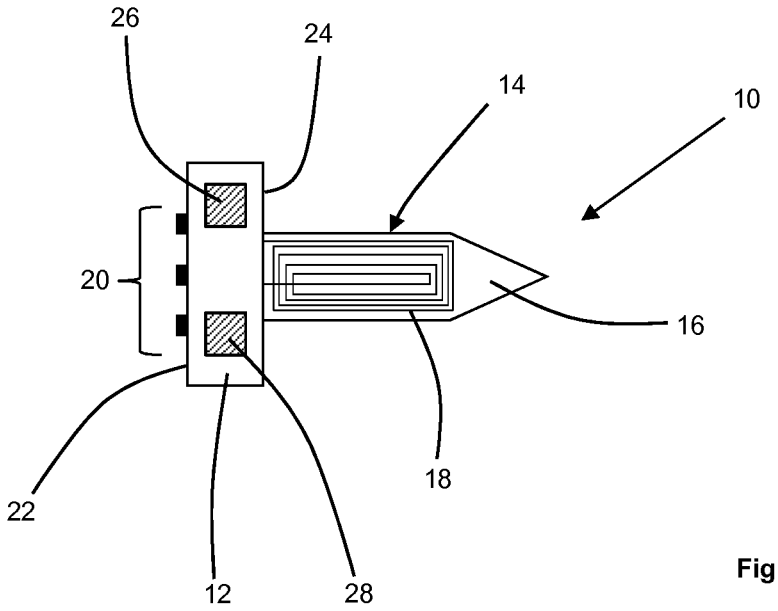
FIG. 1 shows a cross-sectional view of a heater assembly according to a first embodiment of the present invention.

FIG. 1 shows a heater assembly 10 according to a first embodiment of the present invention. The heater assembly 10 comprises a base portion 12 and an elongate electrical heater 14 extending from the base portion 12. The electrical heater 14 comprises an electrically insulating substrate 16 and a resistive heating element 18 positioned on the electrically insulating substrate 16.

The heater assembly 10 further comprises a plurality of electrical contacts 20 provided on a first end face 22 of the base portion 12, which will be described in further detail with respect to FIGS. 2 and 3. The electrical heater 14 extends from a second end face 24 of the base portion 12. A data storage device 26 is provided on the base portion 12, the data storage device 26 storing calibration data for the electrical heater 14. A heater communication interface comprises a wireless data connector 28 for providing communication between the data storage device 26 and an aerosol-generating device.

Figure 2:
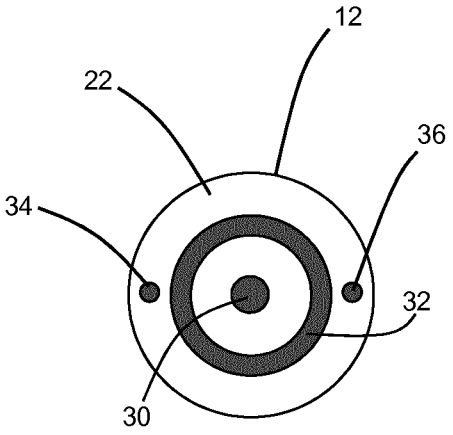
FIG. 2 shows an end view of the heater assembly of FIG. 1.

FIG. 2 shows the first end face 22 of the base portion 12 to illustrate in further detail the arrangement of the electrical contacts 20. The heater assembly 10 comprises first and second heater electrical contacts 30, 32 for supplying electrical power to the resistive heating element 18 to heat the electrical heater 14. The first and second heater electrical contacts 30, 32 are circular and concentric to accommodate any rotational orientation of the heater assembly 10 when the heater assembly 10 is inserted into an aerosol-generating device. The heater assembly 10 further comprises third and fourth heater electrical contacts 34, 36 for measuring the electrical resistance of the resistive heating element 18 during manufacture of the heater assembly 10, to generate the calibration data stored on the data storage device 16. The electrical resistance of the third and fourth heater electrical contacts 34, 36 is smaller than the electrical resistance of the first and second heater electrical contacts 30, 32.

Figure 3:
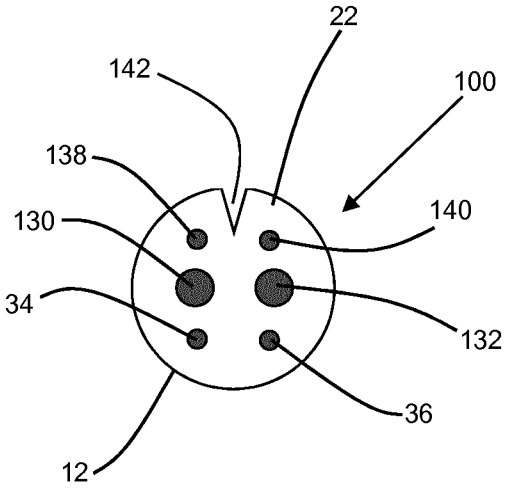
FIG. 3 shows an end view of a heater assembly according to a second embodiment of the present invention.

FIG. 3 shows the first end face 22 of the base portion 12 of a heater assembly 100 according to a second embodiment of the present invention. The heater assembly 100 is similar to the heater assembly 10 and like reference numerals are used to designate like parts. In particular, the heater assembly 100 comprises an electrical heater 14 and a data storage device 26 identical to those described with reference to FIG. 1.

The heater assembly 100 does not include a wireless data connector, but instead comprises a heater communication interface comprising first and second data electrical contacts 138, 140 positioned on the first end face 22 of the base portion 12. The first and second data electrical contacts 138, 140 facilitate communication with the data storage device 26.

The first and second heater electrical contacts 130, 132 of the heater assembly 100 are not concentrically positioned on the first end face 22 of the base portion 12. Therefore, the heater assembly 100 comprises a groove that forms an indexing indicator 142. The groove interacts with a protrusion on an aerosol-generating device to ensure that the heater assembly 100 is inserted into the aerosol-generating device in the correct rotational orientation.

Figure 4:
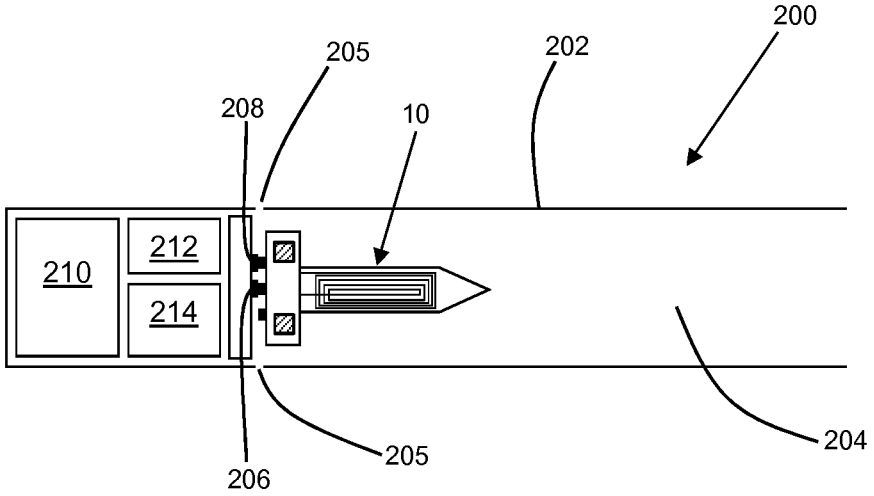
FIG. 4 shows an aerosol-generating device comprising the heater assembly of FIG. 1.

FIG. 4 shows a cross-sectional view of an aerosol-generating device 200 comprising the heater assembly 10 of FIGS. 1 and 2. The aerosol-generating device 200 further comprises a housing 202 defining a cavity 204 for removably receiving the heater assembly 10 and an aerosol-generating article, and a plurality of air inlets 205 for admitting air into the cavity 204.

The aerosol-generating device 200 comprises first and second device electrical contacts 206, 208 for electrically connecting to the first and second heater electrical contacts 30, 32. At least one of the first and second device electrical contacts 206, 208 and the first and second heater electrical contacts 30, 32 is magnetic to releasably secure the heater assembly 10 within the cavity 204. Therefore, the first and second heater electrical contacts 30, 32 form a heater assembly attachment connector and the first and second device electrical contacts 206, 208 form a device attachment connector.

The aerosol-generating device 200 further comprises a power supply 210, a controller 212 and a device communication interface 214 comprising a wireless data connector configured to establish a data connection with the wireless data connector 28 of the heater assembly 10. In use, the controller 212 is configured to receive the calibration data from the data storage device 26 via the wireless data connectors of the heater assembly 10 and the aerosol-generating device 200. Based on the calibration data, the controller 212 controls a supply of electrical power from the power supply 210 to the electrical heater 14 of the heater assembly 10 to heat an aerosol-generating article received within the cavity 204, as will now be described with reference to FIG. 5.

Figure 5:
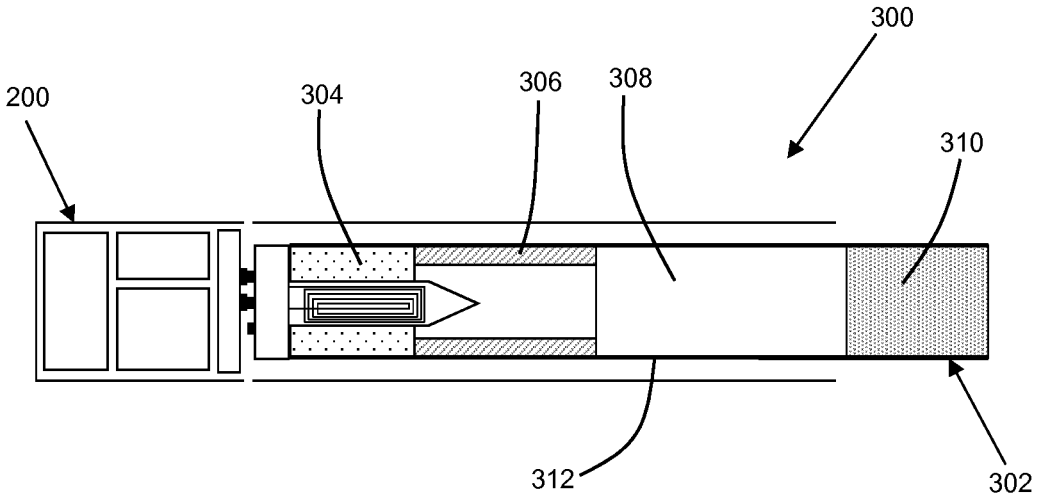
FIG. 5 shows an aerosol-generating system comprising the aerosol-generating device of FIG. 4 and an aerosol-generating article.

FIG. 5 shows a cross-sectional view of an aerosol-generating system 300 comprising the aerosol-generating device 200 of FIG. 4 and an aerosol-generating article 302 removably received within the cavity 204. The aerosol-generating article 302 comprises an aerosol-forming substrate 304 in the form of a tobacco plug, a hollow acetate tube 306, a polymeric filter 308, a mouthpiece 310 and an outer wrapper 312. When the aerosol-generating article 302 is received within the cavity 204 of the aerosol-generating device 200, the electrical heater 14 of the heater assembly 10 is received within the tobacco plug. Therefore, during use, the electrical heater 14 heats the tobacco plug to generate an aerosol therefrom.

The invention claimed is:

1. A removable heater assembly for an aerosol-generating device, the removable heater assembly being configured to heat a tobacco plug and comprising:

an electrical heater;

a data storage device;

data stored on the data storage device, the data comprising calibration data for the electrical heater;

a first heater electrical contact and a second heater electrical contact, the first and the second heater electrical contacts being configured to receive a supply of electrical energy for supply to the electrical heater for heating the electrical heater; and a third heater electrical contact and a fourth heater electrical contact, the third and the fourth heater electrical contacts being configured to facilitate measurement of an electrical resistance of the electrical heater, wherein the removable heater assembly is configured to be removably attached to the aerosol-generating device.

2. The removable heater assembly according to claim 1, wherein the electrical heater is an elongate electrical heater configured to be inserted into the tobacco plug.

3. The removable heater assembly according to claim 1, further comprising a heater assembly attachment connector configured to removably attach the removable heater assembly to the aerosol-generating device.

4. The removable heater assembly according to claim 3, wherein the heater assembly attachment connector comprises at least one of a resilient clip, a screw connector, a bayonet connector, and a magnetic connector.

5. The removable heater assembly according to claim 1, further comprising a base portion having a first end face on which the first and the second heater electrical contacts are disposed and a second end face on which the electrical heater is disposed.

6. The removable heater assembly according to claim 5, wherein the first and the second heater electrical contacts are circular electrical contacts disposed concentrically on the first end face of the base portion.

7. The removable heater assembly according to claim 1, wherein the electrical heater comprises a resistive heating element having a first end connected to the first and the third heater electrical contacts and a second end connected to the second and the fourth heater electrical contacts.

8. The removable heater assembly according to claim 7, wherein the first electrical contact has a first electrical resistance, the second electrical contact has a second electrical resistance, the third electrical contact has a third electrical resistance, and the fourth electrical contact has a fourth electrical resistance, wherein the third electrical resistance is smaller than the first electrical resistance, and wherein the fourth electrical resistance is smaller than the second electrical resistance.

9. The removable heater assembly according to claim 1, wherein the calibration data represents a voltage-temperature profile for the electrical heater.

10. The removable heater assembly according to claim 1, further comprising a heater communication interface configured to provide data transfer between the data storage device and the aerosol-generating device.

11. The removable heater assembly according to claim 10, wherein the heater communication interface comprises a wireless data connector.

12. The removable heater assembly according to claim 11, wherein the wireless data connector is configured to operate using at least one of radio-frequency identification (RFID), near-field communication (NFC), BLUETOOTH®, ZIGBEE®, WI-FI®, and ultra-wideband.

13. The removable heater assembly according to claim 10, wherein the heater communication interface comprises at least one heater data electrical contact configured for connection to at least one device data electrical contact on the aerosol-generating device.

14. A method of manufacturing a removable heater assembly according to claim 1, the method comprising:

providing an electrical heater and a data storage device;

combining the electrical heater and the data storage device to form the removable heater assembly;

supplying power to the electrical heater;

collecting calibration data for the electrical heater during the step of supplying power to the electrical heater; and storing the collected calibration data on the data storage device.

15. A method of calibrating a removable heater assembly according to claim 1, the method comprising:

supplying power to the electrical heater;

collecting calibration data for the electrical heater during the step of supplying power to the electrical heater; and storing the collected calibration data on the data storage device.

16. An aerosol-generating device, comprising:

a removable heater assembly being configured to heat a tobacco plug and comprising an electrical heater, a data storage device, and data stored on the data storage device, the data comprising calibration data for the electrical heater;

a housing defining a cavity configured to removably receive the removable heater assembly and an aerosol-generating article;

a power supply; and a controller configured to receive data from the data storage device of the removable heater assembly and to control a supply of electrical power from the power supply to the electrical heater of the removable heater assembly based on the received data, wherein the removable heater assembly further comprises:

a first heater electrical contact and a second heater electrical contact, the first and the second heater electrical contacts being configured to receive a supply of electrical energy for supply to the electrical heater for heating the electrical heater, and a third heater electrical contact and a fourth heater electrical contact, the third and the fourth heater electrical contacts being configured to facilitate measurement of an electrical resistance of the electrical heater.

17. The aerosol-generating device according to claim 16, wherein the removable heater assembly further comprises a heater assembly attachment connector configured to removably attach the removable heater assembly to the aerosol-generating device, and wherein the aerosol-generating device further comprises a device attachment connector positioned within the cavity and configured to cooperate with the heater assembly attachment connector to removably attach the removable heater assembly within the cavity.

18. The aerosol-generating device according to claim 16, wherein the removable heater assembly further comprises a heater assembly attachment connector configured to removably attach the removable heater assembly to the aerosol-generating device, wherein the heater assembly attachment connector comprises at least one of a resilient clip, a screw connector, a bayonet connector, and a magnetic connector, wherein the aerosol-generating device further comprises a first device electrical contact disposed within the cavity and configured for electrical connection with the first heater electrical contact, and a second device electrical contact disposed within the cavity and configured for electrical connection with the second heater electrical contact, wherein the controller is further configured to control a supply of electrical power from the power supply to the electrical heater via the first and the second device electrical contacts and the first and the second heater electrical contacts.

19. The aerosol-generating device according to claim 16, wherein the removable heater assembly further comprises a heater communication interface configured to provide data transfer between the data storage device and the aerosol-generating device, and wherein the aerosol-generating device further comprises a device communication interface configured to establish a data link with the heater communication interface.

20. An aerosol-generating system, comprising:

an aerosol-generating device according to claim 16; and an aerosol-generating article comprising an aerosol-forming substrate.

21. A method of assembling an aerosol-generating device according to claim 16, the method comprising:

providing a housing defining a cavity configured to removably receive an aerosol-generating article;

positioning a controller and a power supply within the housing; and inserting a removable heater assembly into the cavity, the removable heater assembly comprising an electrical heater, a data storage device, and data stored on the data storage device, the data comprising calibration data for the electrical heater.

22. A method of replacing a removable heater assembly within an aerosol-generating device according to claim 16, the method comprising:

removing the removable heater assembly from the cavity of the aerosol-generating device;

providing a replacement removable heater assembly comprising another electrical heater, another data storage device, and another data stored on the data storage device, the data comprising calibration data for the another electrical heater; and inserting the replacement removable heater assembly into the cavity.

* * * * *